US006231377B1

(12) United States Patent
Fernsebner

(10) Patent No.: US 6,231,377 B1
(45) Date of Patent: May 15, 2001

(54) POSITIONAL ENCODER WITH AN ELECTRICAL CONNECTION UNIT

(75) Inventor: Peter Fernsebner, Bergen (DE)

(73) Assignee: Dr. Johannes Heidenhain GmbH, Traunreut (DE)

( * ) Notice: Subject to any disclaimer, the term of this patent is extended or adjusted under 35 U.S.C. 154(b) by 0 days.

(21) Appl. No.: 09/656,872

(22) Filed: Sep. 7, 2000

(30) Foreign Application Priority Data

Sep. 10, 1999 (DE) ..... 199 44 909

(51) Int. Cl.[7] ..... H01R 12/24
(52) U.S. Cl. ..... 439/493; 439/395
(58) Field of Search ..... 439/81, 260, 630, 439/862, 492, 493, 494, 499, 391, 394, 395

(56) References Cited

U.S. PATENT DOCUMENTS

| | | | | |
|---|---|---|---|---|
| 4,493,007 | * | 1/1985 | Sugitani | 361/307 |
| 5,188,536 | * | 2/1993 | Ganthier et al. | 439/83 |
| 5,411,409 | | 5/1995 | Gray et al. | 439/329 |
| 5,713,745 | | 2/1998 | Sakurai et al. | 439/78 |
| 6,050,842 | * | 4/2000 | Ferrill et al. | 439/404 |
| 6,050,845 | * | 4/2000 | Smalley, Jr. et al. | 439/417 |
| 6,093,048 | * | 7/2000 | Arnett et al. | 439/404 |
| 6,109,950 | * | 8/2000 | Trammel | 439/404 |

FOREIGN PATENT DOCUMENTS

| | | |
|---|---|---|
| 1987766 | 2/1968 | (DE) . |
| 3607409 | 6/1987 | (DE) . |
| 9604489 | 8/1997 | (DE) . |

* cited by examiner

*Primary Examiner*—Tulsidas Patel
(74) *Attorney, Agent, or Firm*—Brown & Wood, LLP

(57) ABSTRACT

A positional encoder assembly including a plug-in connector, a circular connector spaced from the positional encoder, a ribbon cable connected, at one of its opposite ends, with the plug-in connector and, at another of its opposite ends, with the circular connector, and an adaptor board arranged between the another end of the ribbon cable and the circular connector for connecting electrical conductors of the ribbon cables with the contact pins of the circular connector, with the adaptor board transforming an arrangement of the electrical conductors in the ribbon cable into an arrangement of the contact pins of the circular connector different from the arrangement of the conductors in the ribbon cable.

13 Claims, 7 Drawing Sheets

POSITIONAL ENCODER WITH AN ELECTRICAL CONNECTION UNIT

BACKGROUND OF THE INVENTION

1. Field of the Invention

The present invention relates to a positional encoder assembly consisting of a positional encoder and an electrical connection unit.

2. Description of the Prior Act

A positional encoder assembly consisting of a positional encoder and an electrical connection unit is disclosed in German Publication DE 196 04 489 A1. In the known assembly, an electrical plug-in connector is arranged on a board of a shaft encoder and is connected with a flexible printed circuit which has an end located outside of the encoder housing and connected with a connector plug. The connection pins of the connector plug are soldered to strip conductors of the printed circuit. This electrical connection is expensive in manufacturing, and the solder connections can be fractured.

In the known assembly, the printed circuit is provided with coating layers for protection against electromagnetic fields. The coating layers are electrically connected with the encoder housing by clamping.

The object of the present invention is to provide a positional encode assembly with an electrically connection unit and which can be produced in a simple manner and cost-effectively.

Another object of the present invention is to provide a positional encoder assembly with a reliable connection of the encoder with a mating connector.

SUMMARY OF THE INVENTION

These and other objects of the present invention, which will become apparent herein after are achieved by providing a positional encoder assembly including a plug-in connector, a circular connector spaced from the positional encoder and having a plurality of contact pins, and a ribbon cable connected, at one of its opposite ends, with the plug-in connector and, at another of its opposite ends, with the circular connector. An adaptor board is arranged between the another end of the ribbon cable and the circular connector for connecting electrical conductors of the ribbon cable with the contact pins of the circular connector. The adaptor board transforms an arrangement of the electrical conductors in the ribbon cable into an arrangement of the contact pins of the circular connector which is different from the arrangement of the electrical conductors in the ribbon cable. According to the present invention, a ribbon cable replaces a rather expensive circular cable which is also difficult to connect. A ribbon cable can be rather easily connected with a connector by a ribbon cable connector with insulation displacement contacts.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
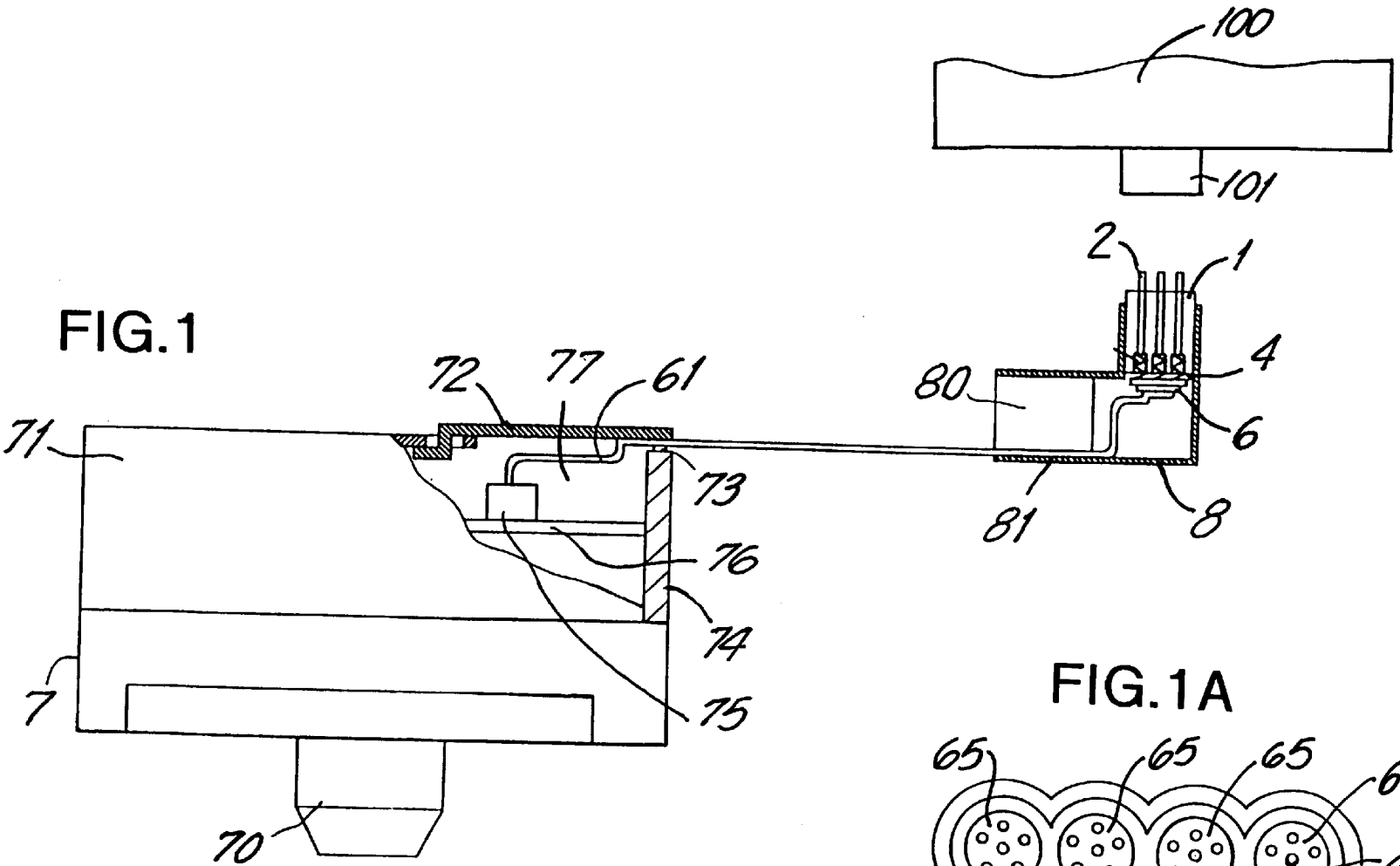
FIG. 1 a schematic view of a positional encoder with an electrical connection unit according to the present invention.
Figure 1A:
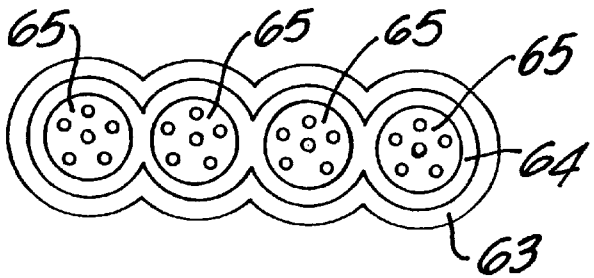
FIG. 1*a* a cross-sectional view of a ribbon cable.

A positional encoder according to the present invention, which is shown in FIG. 1, is formed, in the embodiment shown in FIG. 1, as a shaft encoder 7 for determining a position of a shaft of a drive system. The shaft encoder 7 includes a housing 71 in which a shaft 70 is arranged. Inside the housing 71, a printed circuit board 76 is arranged. The printed circuit board 76 contains electronic components of the shaft encoder 7 which would not be discussed further. The printed circuit board 76 is provided with a plug-in connector 75 that connects a ribbon cable 61 with the printed circuit board 76. To provide access to the plug-in connector 75, a displaceable cover 72 is provided on the housing 71 for closing an opening 77 of the housing 71. In the embodiment shown, the ribbon cable 61 has a conducting layer 63 placed over its insulation 64. The outer layer 63 can be formed as a vapor-deposited metallic layer. The ribbon cable 61, a cross-section of which is shown in FIG. 1*a,* includes a plurality of conductors 65 arranged adjacent to each other and surrounded by the insulation 64 which is covered by the metallic layer 63.

The ribbon cable 61 runs from inside the housing 71 through the opening 77 out. The ribbon cable 61 is clamped between the cover 72 and the electrically conductive housing 71, whereby the conducting layer 63 of the ribbon cable 61 is so electrically connected with the housing 71 that a very good shielding is achieved. In addition, the clamping of the ribbon cable 61 between the cover 72 and the housing 71 insures an adequate strain relief of the ribbon cable 61.

The ribbon cable 61, which runs out of the housing 71, is inserted into an angular connector 8, the opening of which is closed with an insulation member 80. The ribbon cable 71 is so stretched in the electrically conductive housing 81 of the connector 8 that there is provided a contact between the conductive layer 63 of the ribbon cable 61 and the housing 81, whereby an electrical shielding is established. At the second opening of the angular connector 8, there is provided an electrical connection unit with which the ribbon cable 61 is connected. For the sake of clarity, of the components of the electrical connection unit, only an input member 1, contact pins 2, springs 3, an adaptor board 4, and a ribbon cable connector 61 with insulation displacement contacts, which serves for connection of the ribbon cable 61 with the electrical connection unit, are shown.

Motors 100 usually are provided each with a circular connector 101. Through in the embodiment described above, an angular connector is used for connecting the cable 61 of the shaft encoder 7 with the motor 100, the shaft encoder 7 can be directly connected with the circular connector 101 of the motor 7 when the adaptor board 4 is provided on the shaft encoder itself.

It is to be noted that the above-described electrical connection unit can be used not only with a shaft encoder. It can also be used with a linear encoder.

Figure 2:
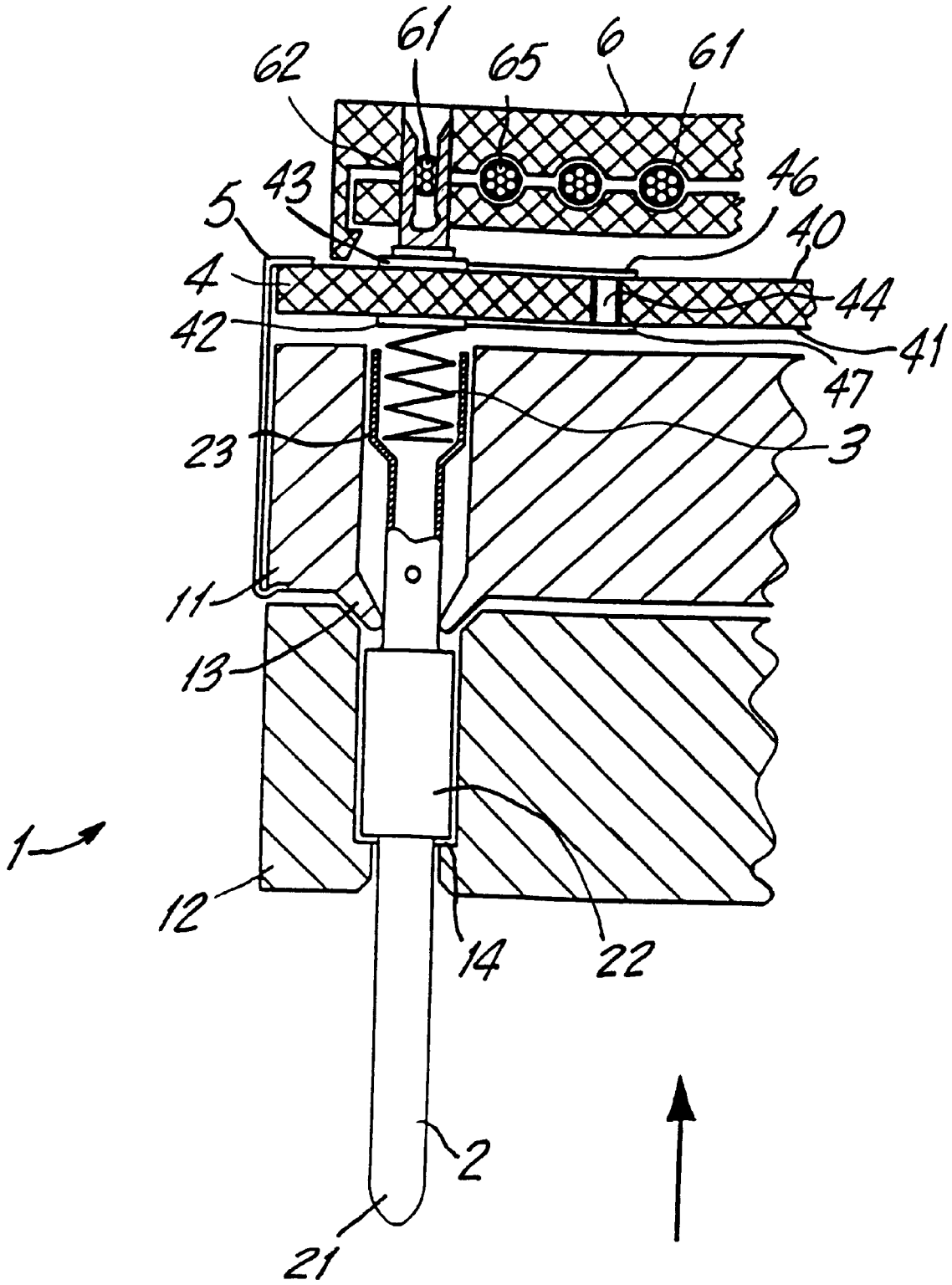
FIG. 2 a cross-sectional view of an electrical connection unit according to the present invention with an adaptor board.

FIG. 2 shows another embodiment of an electrical connection unit according to the present invention. The unit is designed for mounting on the shaft encoder shown in FIG. 1 and serves for connecting the ribbon cable 61, which is connected with the electronics of the shaft encoder 7, with a multi-pole circular connector.

Figure 3:
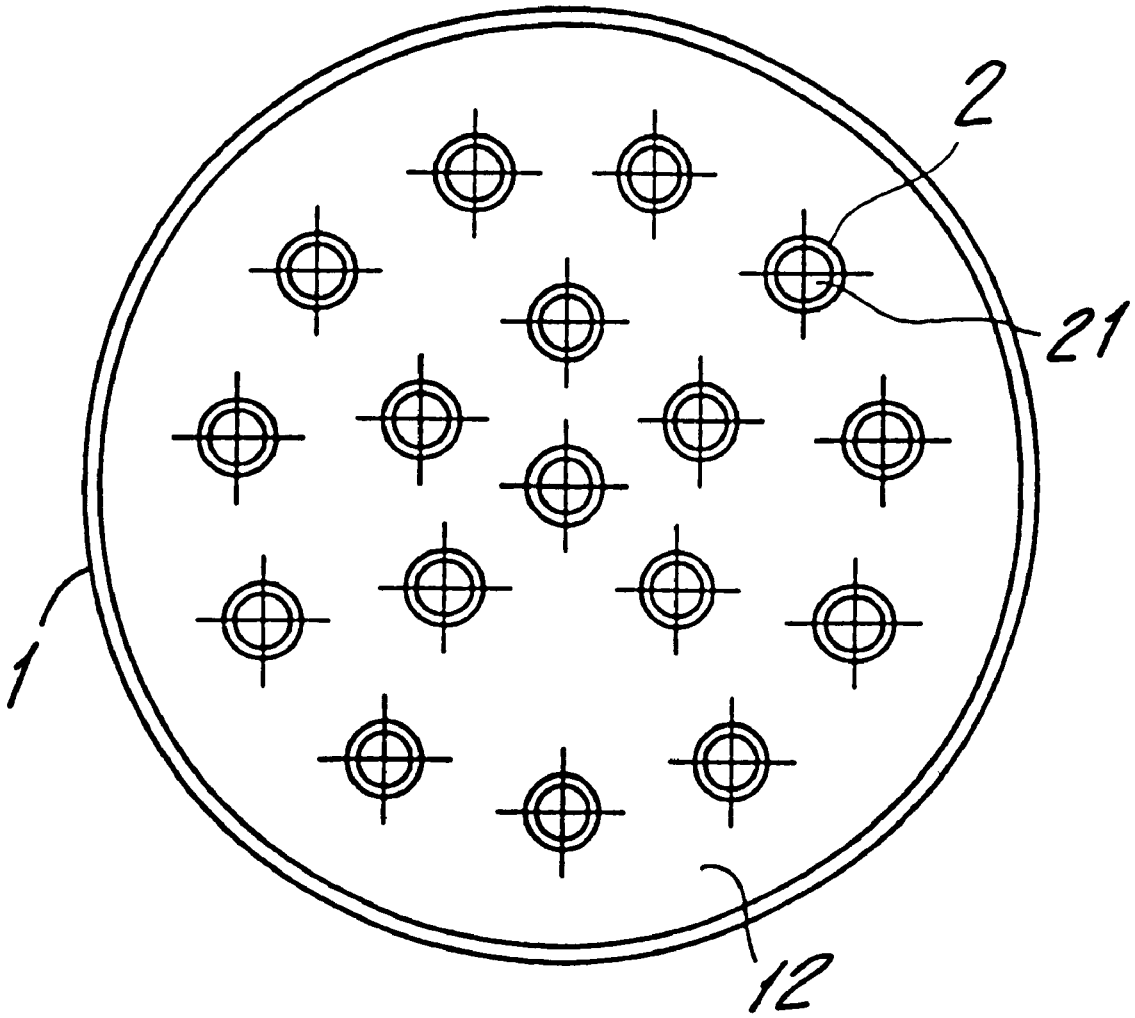
FIG. 3 a plan view in the direction of arrow A of the electrical connection unit shown in FIG. 2.

The electrical connection unit, which is shown in FIG. 2, includes an input member 1 formed of an electrically insulating material. The input member 1 is formed of input upper part 11 and an input lower part 12. In the openings of the input upper and lower parts 11 and 12, there are arranged conventional contact pins 2 having each a crimp opening 23 and a contact tip 21. Only one contact pin is shown in FIG. 2. The contact pin 2 is so arranged that it can be connected with a conventional multi-pole mating connector, in particular, a circular connector. The arrangement of contact pins 2 is shown in FIG. 3.

Below, the structure of the contact pin 2 and its cooperation with other components of the electrical connection unit will be discussed in detail with reference to contact pin 2 shown in FIG. 2.

As shown in FIG. 2, a member 22, which is arranged in a receptacle 14 of the input part 12 and is supported against a stop surface, adjoins the contact tip 21. In the vicinity of the member 22, the contact pin 2 is held with clamping jaws 13 provided on the input upper part 11. The clamping jaws 13 and the receptacle 14 fix the member 22 and, thereby, the contact pin 2 in the direction of arrow A. Transverse to the direction A and, thus, transverse to the connection direction, where the multi-pole connector is connected to the electrical connection unit, the contact pin 2 is fixed with the clamping jaws only in one region. Above and below of this region, between the contact pin 2 and the input upper and lower parts 11, 12, there are provided clearances, so that upon connection of the contact tip 21 with the connector, the position of a connector sleeve, which is associated with the contact pin 2, can be correspondingly adapted as a result of compensation movement transverse to the connection direction A.

A metal spring 3 is arranged in the crimp opening 23 of the contact pin 2. The metal spring 3 electrically connects the contact pin 2 with as associated contact surface 42 on the bottom 41 of the adaptor board 4. The adaptor board 4 is formed as a printed circuit board that connects the contact pin 2 and thereby the multi-pole connector with a ribbon cable connector 6. The contact surface 42 is connected with a contact surface 43, which is provided on the upper surface of the adaptor board 4, via an electrical passage 44. This arrangement will be explained in more detail below. The contact surfaces 42 and 43 are formed by respective electrically conductive layers on the opposite surfaces of the adaptor board 4. The spring 3 is supported in the crimp opening 23, on one hand, and against the contact surface 42, on the other hand. The resiliency of spring 3 in the direction transverse to the connection direction A insures movable positioning of the contact pin 2 in the input member 1 and, despite this, a reliable electrical contact between the contact surface 42 and the contact pin 2 which results from the spring pressure applied to the contact surface 42. The spring 3 is arranged between the contact surface 42 and the contact pin 2 in a preloaded condition, i.e., in compressed condition.

As it has already been mentioned, the electrical connection unit includes a plurality of contact pins 2. Respective contact surfaces 42 on the bottom surface 41 and contact surfaces 43 on the upper surface 40 of the adaptor board 4 are associated with respective contact pins 2. At each contact surface 43, an insulation displacement contact 62 of the connector 6 is soldered. The connector 6, which can be mounted on the upper surface 40 of the adaptor board 4, connects the ribbon cable 61 with the electrical connection unit. In an alternative (not shown) embodiment of the electrical connection unit according to the present invention, a connector can be provided on the upper surface 40 of the adaptor board 4 and be electrically connected with the contact surfaces 43 by soldering. With this alternative electrical connection unit, the ribbon cable 61 is connected with the electrical connection unit by a ribbon cable connector with insulation displacement contacts, which is connected with the ribbon cable and which can be pinned up on the circular connector. The advantage of the alternative embodiment of the electrical connection unit consists in that the connection of the ribbon cable with the electrical connection unit can be easy to realize.

The advantage of the ribbon cable 61 consists in that the conductors 65 form a predetermined raster and thereby can be cost-effectively automatically produced and easily connected with the ribbon cable connector. On the other hand, they require a very small mounting space.

Figure 4:
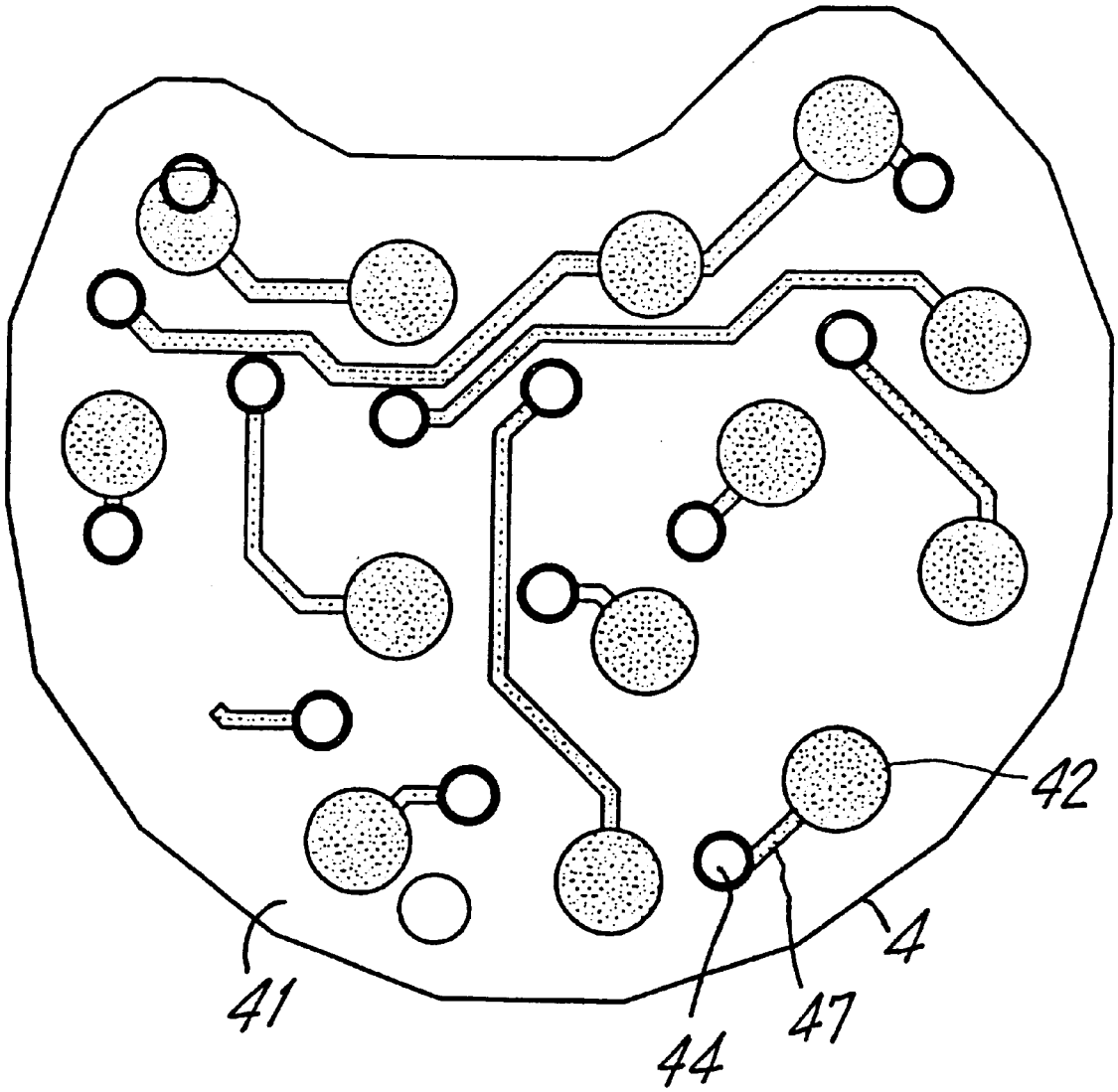
FIG. 4 a bottom view of the adaptor board shown in FIG. 2.
Figure 5:
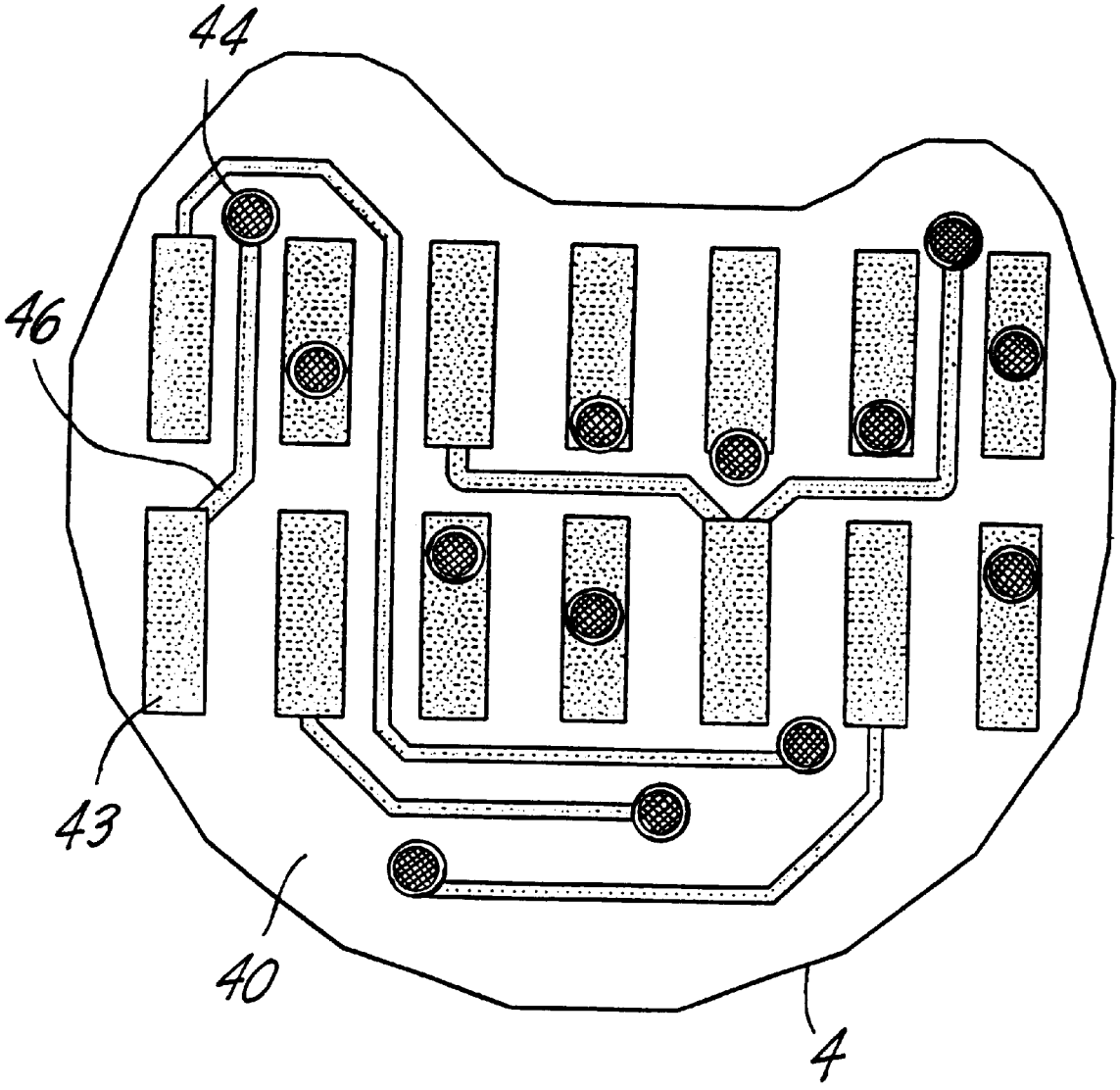
FIG. 5 a plan view of the upper surface of the adaptor board shown in FIG. 2.

The arrangement of the contact surfaces 42 and 43 on the adaptor board 4 and the connection of the arrangement of contact pins 2 in the input member 1 with the multi-pole circular connector and with the ribbon cable connector 6 is shown in detail in FIGS. 4–5. FIG. 4 shows a plan view of the bottom surface 41 of the adaptor board 4. The pattern of the arrangement of the contact surfaces 42 corresponds to the pattern of the arrangement of the contact pins 2. The contact surfaces 42 are connected by strip conductors 47 with respective electrical passages 44 which connect the contact surfaces 42 on the bottom surface 41 of the adaptor board 4 with the contact surfaces 43 on the upper surface 40 of the adaptor board 4.

The arrangement of the contact surfaces 43 on the upper surface 40 of the adaptor board 4 is shown in FIG. 5. The contact surfaces 43 are connected with the electrical passages 44 with respective strip conductors 46 and form two parallel rows of the contact surfaces. Therefore, they are easily, without any problems, are connectable with the ribbon cable connector 6.

The adaptor board 4, which is shown in FIG. 2, is formed, with the use of a clamp connector 5, as a resilient member, with which the input upper part is connected.

Figure 6:
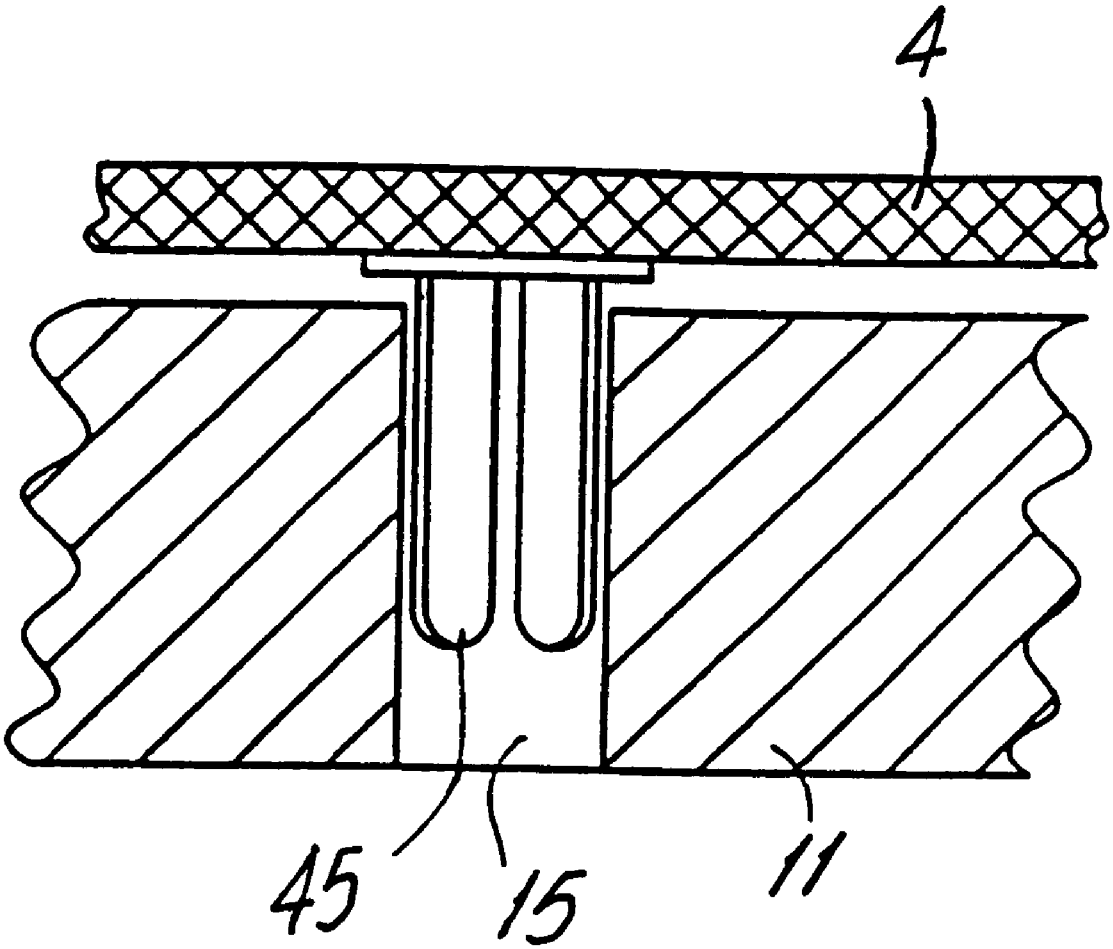
FIG. 6 a cross-sectional view showing a grooved pin connection for connecting the adaptor board with an input member of an electrical connection unit according to the present invention.

FIG. 6 shown an alternative connection of the adaptor board 4 with the upper part 11 of the input member 1. In this embodiment, the adaptor board 4 is connected with the upper part 11 by grooved pins 45. The grooved pins 45 are secured to the adaptor board 4 and extend into openings 15 of the upper part 11, force-and/or formlockingly engaging therein. It is to be pointed out that the present invention is not limited to the arrangement of the adaptor board 4 on the upper part 11 shown in FIG. 2 or to the connection of the adaptor board 4 with the upper part 11 shown in FIG. 6. E.g., the adaptor plate 4 can be glued to the upper part 11. In the mounted condition, the adaptor board 4 is fixedly secured to the upper surface to a most possible extent.

The connection of the upper part 11 with the lower part 12 is effected in a known manner with respective locking elements provided on the two parts 11 and 12. The locking elements for connecting the upper part 11 with the adaptor board 4 can also be provided or formed on the upper part 11.

Figure 7:
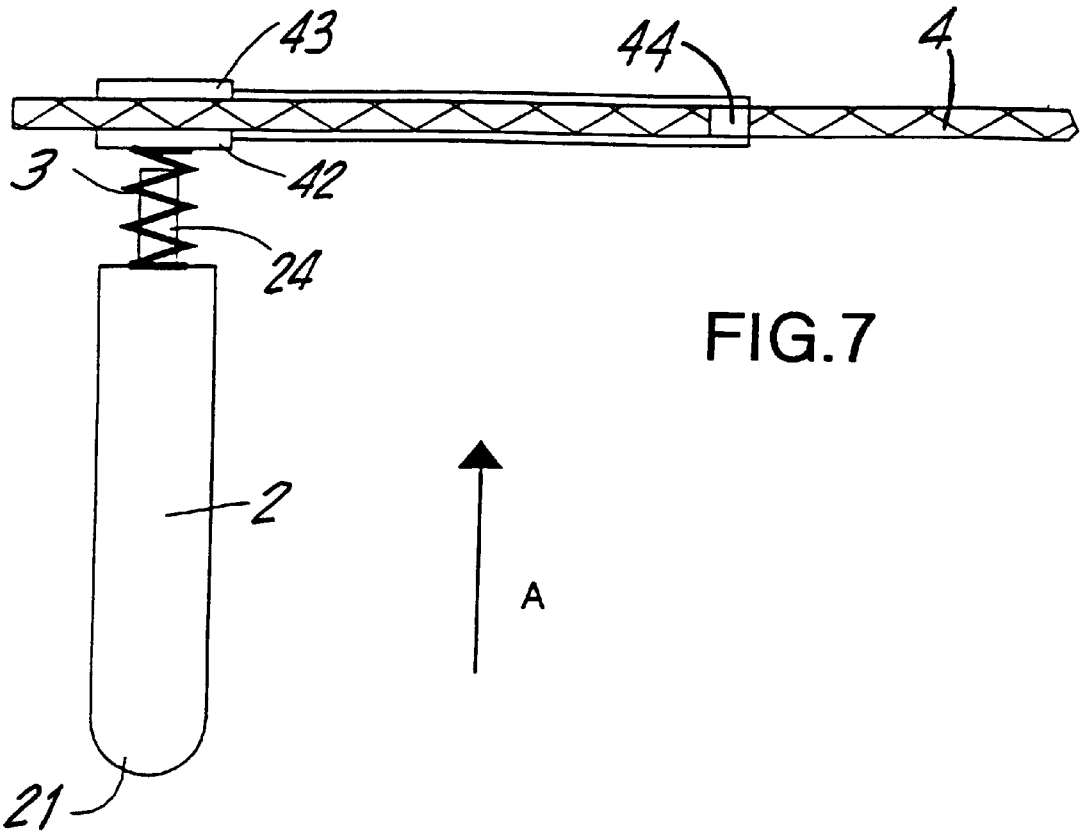
FIG. 7 a schematic view showing means for supporting a helical spring on a contact pin of an electrical connection unit according to the present invention.

FIG. 7 shown another arrangement of the spring 3, which is formed as a helical spring, on a contact pin 2. In distinction form the arrangement shown in FIG. 2, the spring is not supported in a crimp opening. Rather, a support pin 24 is formlockingly secured in the opening in the contact pin 2, with the spring 3 surrounding the pin 24. Alternatively, the support pin 24 can be formed integrally with the contact pin 2. The spring 3 has one of its opposite ends supported on the contact pin 2. With its other end, the spring 3 mechanically engages the contact surface 42, forming an electrical contact therewith. The resilience of the spring 3 provides for a reliable electrical connection of the spring 3 with both the contact surface 42 and the contact pin 2. The adaptor board 4 is shown in FIG. 7 schematically.

Figure 8:
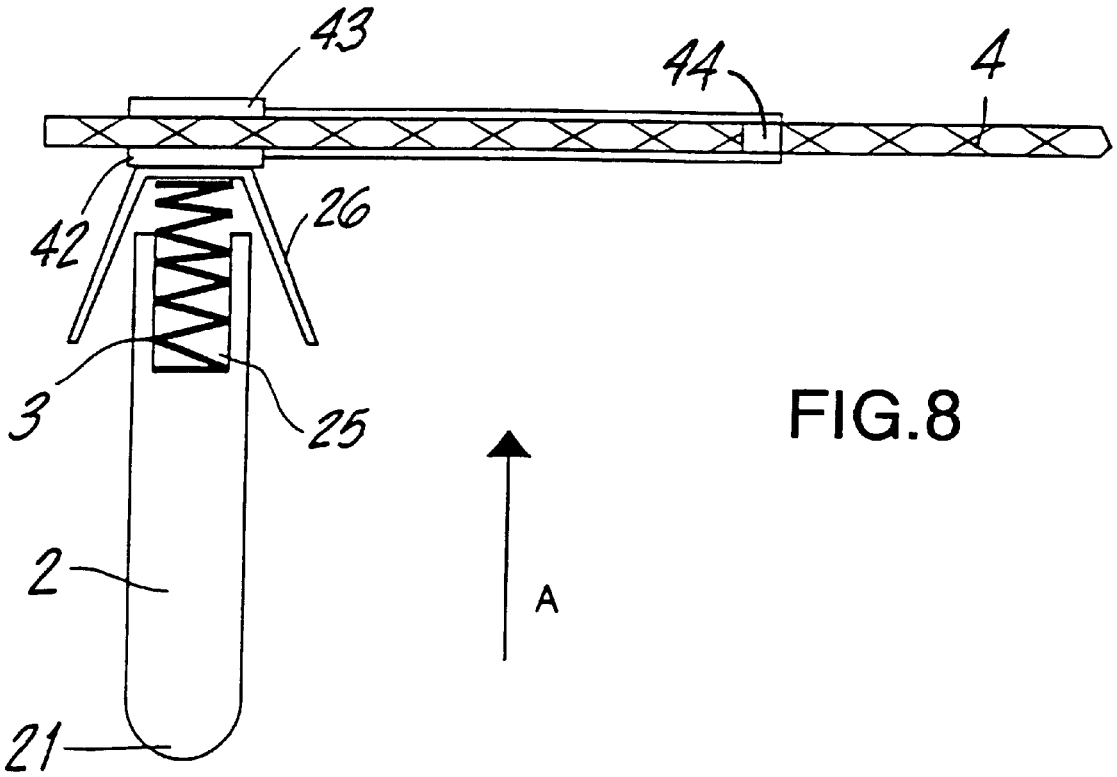
FIG. 8 a schematic view showing another means for supporting a helical spring on a contact pin of an electrical connection unit according to the present invention.

In the embodiment shown in FIG. 8, the contact pin 2 is connected with the contact surface 42 of the adaptor board 4 by a multi-component connection element. The connection element has two parts telescopically connected with each other. Here, "telescopically connected" means displaceable relative to each other in a telescope-like manner. The connection element includes the spring 3 arranged in a receiving opening formed in the contact pin 2. If a conventional contact pin is used, the spring 3 can be arranged therein in a manner shown in FIG. 2. A cup-shaped member 26, which is formed of a conductive material is placed on the spring 3. E.g., the cup-shaped member 26 can be formed of electroconductive metal. The surface of the member 26 contacts the contact surface 42 of the adaptor board 4. This embodiment as the previous ones, insures a floating positioning of the contact pin 2 relative to the adaptor board 4 transverse to the connection direction A.

The surface of the cup-shaped member 26, which contacts the contact surface 42, need not be flat. It can be spherical or form an angle. The main thing is that the spring 3 and the cup-shaped member 26 should insure an electrical connection between the contact pin 2 and the adaptor board 4, and should insure a floating positioning of the contact pin 2 relative to the adaptor board 4.

In accordance with one embodiment (not shown), the cup-shaped member 26 is soldered to the contact surface 42. In this embodiment, the cup-shaped member 26 performs two functions. According to one function, the cup-shaped member 26 serves, during mounting of the electrical connection unit, as auxiliary mounting means, facilitating mounting of the adaptor board 4 on the upper part 11. After mounting, the member 26 serves as an electrical connection element.

In the above described embodiments of the electrical connection unit according to the present invention, the spring 3 is used for establishing of an electrical connection of the contact pin 2 with the contact surface 42 of the adaptor board 4. The spring 3, due to its resilience, insures a reliable electrical connection of the contact pin 2 with the contact surface 42 of the adaptor board 4. However, the present invention is not limited to using springs for establishing an electrical connection between the contact pins and the adaptor board. Rather, any electrically conductive and resilient member can be used to this end, e.g., formed of an electrically conductive elastomeric material.

Accordingly, thought the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A positional encoder assembly, comprising:

a positional encoder;

a plug-in connector located in the positional encoder;

a circular connector spaced from the positional encoder and having a plurality of contact pins;

a ribbon cable connected, at one of opposite ends thereof, with the plug-in connector and, at another of opposite ends thereof, with the circular connector;

an adaptor board for connecting the another end of the ribbon cable with the circular connector; and a ribbon cable connector for connecting the another end of the ribbon cable with the adaptor board, the ribbon cable connector having a plurality of insulation displacement contacts connected with respective conductors of the ribbon cable, with the adaptor board providing for an electrical connection of the insulation displacement contacts of the ribbon cable connector with the contact pins of the circular connector which have an arrangement different from an arrangement of the insulation displacement contact of the ribbon cable connector.

2. A positional encoder assembly as set forth in claim 1, wherein he adaptor plate is arranged between the ribbon cable connector and the circular connector and has, on one side thereof, contacts which are contacted by the insulation displacement contacts of the ribbon cable connector, and has, on another, opposite side thereof, contacts which are contacted by the contact pins of the circular connector.

3. A positional encoder assembly as set forth in claim 1, wherein the circular connector comprises an input body, and wherein the contact pins are arranged in the input body with a possibility of displacement relative to the adaptor board in a direction transverse to a longitudinal extent of the contact pins.

4. A positional encoder assembly as set forth in claim 2, wherein electrical connection means is provided between the contacts on the another, opposite side of the adaptor plates and the contact pins of the circular connector, respectively.

5. A positional encoder assembly as set forth in claim 4, wherein the contact pins of the circular connector have each an opening for receiving a respective electrical connection element of the electrical connection means.

6. A positional encoder assembly as set forth in claim 5, wherein the electrical connection element is formed as a spring.

7. A positional encoder assembly as set forth in claim 5, wherein the electrical connection element is supported, at its opposite ends, against a respective contact pin of the circular connector and a respective contact on the another, opposite side of the adaptor board.

8. A positional encoder assembly as set forth in claim 1, wherein electrical conductors of the ribbon cable have a common insulation covered with a layer of an electrically conductive material.

9. A positional encoder assembly as set forth in claim 8, wherein the positional encoder is formed as a shaft encoder having a housing formed of an electrically conductive material and having a cavity for receiving the plug-in connector, and a cover for covering the opening; wherein the ribbon cable leads away from the cavity and is clamped between the cover and the housing, with the layer of an electrically conductive material of the ribbon cable and the housing forming an electrical connection.

10. A positional encoder assembly, comprising:

a positional encoder;

a plug-in connector located in the positional encoder;

a circular connector spaced from the positional encoder and having a plurality of contact pins;

a ribbon cable connected, at one of opposite ends thereof, with the plug-in connector and, at another end thereof, with the circular connector;

an adaptor board arranged between the another end of the ribbon cable and the circular connector for connecting electrical conductors of the ribbon cables with the contact pins of the circular connector, the adaptor board transforming an arrangement of the electrical conductors in the ribbon cable into an arrangement of the contact pins of the circular connector which is different from the arrangement of the electrical conductors in the ribbon cable.

11. A positional encoder assembly as set forth in claim 10, wherein electrical conductors of the ribbon cable have a common insulation covered with a layer of an electrically conductive material.

12. A positional encoder assembly as set forth in claim 11, wherein the positional encoder is formed as a shaft encoder having a housing formed of an electrically conductive material and having a cavity for receiving the plug-in connector, and a cover for covering the opening; wherein the ribbon cable leads away from the cavity and is clamped between the cover and the housing, with the layer of an electrically conductive material of the ribbon cable and the housing forming an electrical connection.

13. A positional encoder assembly as set forth in claim 12, wherein the circular connector has a housing formed of an electrically conductive material, and wherein the layer of an electrically conductive material of the ribbon cable contacts the circular connector housing.

* * * * *